US005533317A

United States Patent [19]

Galandrino

[11] Patent Number: 5,533,317

[45] Date of Patent: Jul. 9, 1996

[54] ROLLING HEAD FOR APPLYING SEALING CAPS ON BOTTLES IN GENERAL

[75] Inventor: Agostino Galandrino, Canelli, Italy

[73] Assignee: Robino & Galandrino S.p.A., Canelli, Italy

[21] Appl. No.: 498,269

[22] Filed: Jul. 3, 1995

[30] Foreign Application Priority Data

Jul. 8, 1994 [IT] Italy ..... TO94A0560

[51] Int. Cl.[6] ..... B67B 3/18; B65B 7/28

[52] U.S. Cl. ..... 53/334; 53/339

[58] Field of Search ..... 53/334, 338, 339, 53/340, 336, 337, 488

[56] References Cited

U.S. PATENT DOCUMENTS

| | | | |
|---|---|---|---|
| 1,452,410 | 4/1923 | Boucher | 53/340 |
| 1,560,059 | 11/1925 | Johnson | 53/339 |
| 3,771,285 | 11/1973 | Bertario | 53/334 |
| 3,775,944 | 12/1973 | Roberts | 53/334 |

FOREIGN PATENT DOCUMENTS

| | | |
|---|---|---|
| 0366956 | 5/1990 | European Pat. Off. . |
| 938089 | 10/1948 | France . |
| 2132227 | 11/1972 | France . |
| 2259047 | 8/1975 | France . |

*Primary Examiner*—Horace M. Culver
*Attorney, Agent, or Firm*—Guido Modiano; Albert Josif

[57] ABSTRACT

The rolling head is provided with a plurality of presser rollers adapted to act elastically on the cap, each presser roller being supported at the end of a respective rocker that is pivoted to a cylindrical support rigidly coupled to a rotating body of the head. The rockers are subjected to the action of a plurality of respective springs reacting against a contrast ring slideably and axially mounted on the rotating body of the head and fixable in position by means of an abutment ring in order to simultaneously adjust the tension of the plurality of springs.

11 Claims, 3 Drawing Sheets

ROLLING HEAD FOR APPLYING SEALING CAPS ON BOTTLES IN GENERAL

BACKGROUND OF THE INVENTION

The present invention relates to a rolling head for applying sealing caps on bottles of wine, liquor, and beverages in general.

It is known that sealing caps can be made of heat-shrinkable or moldable material, for example polymeric material with fillers constituted by metallic powders, or metal or ductile metal alloys.

The present invention relates to a rolling head for applying caps of the second type, which are made to adhere perfectly to the neck of the bottle, coupling to any raised portions or undercut collars, by means of a plurality of presser rollers of said head, which roll on the cap and apply thereto a pressure directed radially, while the head moves along the neck of the bottle in order to subject the entire extension of the cap to the action of the rollers.

In known rotating rolling heads of the specified type, the presser rollers are located at the ends of respective oscillating shafts that are arranged in a bundle along a hollow rotating body of the head adapted to receive the neck of the bottle and are pivoted to the upper end of said rotating body.

Two or more elastomeric rings cooperate with the bundle of oscillating shafts and elastically tighten them, generating a corresponding elastic radial force on the presser rollers.

The pressure the rollers apply to the cap can be changed by placing the rings at different levels and/or by mutually spacing them in various manners.

Said known rolling heads have several drawbacks; the main one resides in their considerable sensitivity to the action of centrifugal force.

In particular, due to the significant mass of the supporting shafts of the presser rollers, said bundle of shafts, under the action of centrifugal force, tends to open out, significantly reducing the action of the elastomeric rings, with a corresponding significant reduction in the action applied by the presser rollers on the cap, which accordingly does not adhere correctly to the neck of the bottle. It is therefore necessary to significantly limit the rotation rate of the head, correspondingly reducing its efficiency in terms of caps applied in the time unit.

Another drawback of said known rolling heads is the difficulty in performing, and maintaining in the course of time, a correct adjustment of the force applied by the elastomeric rings on the presser rollers, and therefore the corresponding difficulty in adapting the head to the processing of caps of different kinds and consistencies and/or in ensuring a constant-quality and high-standard production.

A presser stem is also associated with said rolling heads and slides axially, under the actuation of elastic means, within a sleeve that supports the rotating body adapted to receive the bottle and having the dual function of keeping in place the cap during rolling and of helping to expel the bottle after rolling. In known rolling heads, this stem is subjected to the action of a plurality of springs according to an arrangement structurally complicated, expensive, and difficult to adjust, which entails additional drawbacks, both from the functional point of view and from the point of view of the complexity of the adjustment operations.

SUMMARY OF THE INVENTION

The aim of the present invention is to eliminate these and other drawbacks of known rolling heads, and within the scope of this general aim it has the important object of providing a rotating rolling head improved from the point of view of its substantial insensitivity to the action of centrifugal force, thus ensuring on one hand the correct application of the caps and allowing, on the other hand, to significantly increase the rotation rate of the head (which can even be doubled), with a consequent significant increase in its yield in the specified terms.

Another important object of the present invention is to provide a rolling head wherein the elastic action applied by the plurality of presser rollers on the cap being processed can be changed easily, very precisely, and simultaneously on all rollers, and wherein it is also possible to accurately set the tension of the individual springs.

The invention also has the additional important object of improving the structure and the arrangement of the elastic means actuating the presser stem, in order to make said means more functional and simplify the operation for adjusting them.

According to the present invention, this aim, these objects, and others are achieved with an improved rolling head having the specific features stated in the appended claims.

Substantially, according to the invention, the head is provided with a plurality of presser rollers, each supported at the end of a respective rocker that is pivoted to a support rigidly coupled to the rotating body of the head. The individual rockers have a profile shaped substantially like a wide L and are provided, at one end, with a supporting stem for a corresponding presser roller freely rotatably mounted on a respective pivot and, at the other end, with an arm that is substantially subhorizontal (with respect to The head in the operating position). A respective spring acts on the subhorizontal arm of each rocker and is preferably of the cylindrical helical type, is arranged subvertically, and reacts against a contrast ring slideably mounted on, but torsionally rigidly coupled to, the rotating body of the head and lockable by an abutment ring in several axial positions that are matched by different tensions of the springs. Said springs have a limited inclination with respect to the vertical axis of the rotating body of the head, for example between 15° and 20°, and therefore their tension is practically insensitive to the action of centrifugal force, which instead tends to make the rockers rotate in the same direction in which the springs act and thus contributes to the action applied by the presser rollers, which increases moderately as the rotation rate of the head increases.

Another feature of the rolling head according to the present invention resides in that the presser stem is provided with an end disk having a thread that is equal to the pitch of a contrast spring acting on said stem, and in that the rigidity of the spring is altered by screwing or unscrewing said disk on the spring, so as to vary the number of elastically active turns.

BRIEF DESCRIPTION OF THE DRAWINGS

Further characteristics and advantages of the rolling head according to the invention will become apparent from the following detailed description thereof and with reference to the accompanying drawings, given by way of non-limitative example, wherein.

DESCRIPTION OF THE PREFERRED EMBODIMENTS

Figure 1:
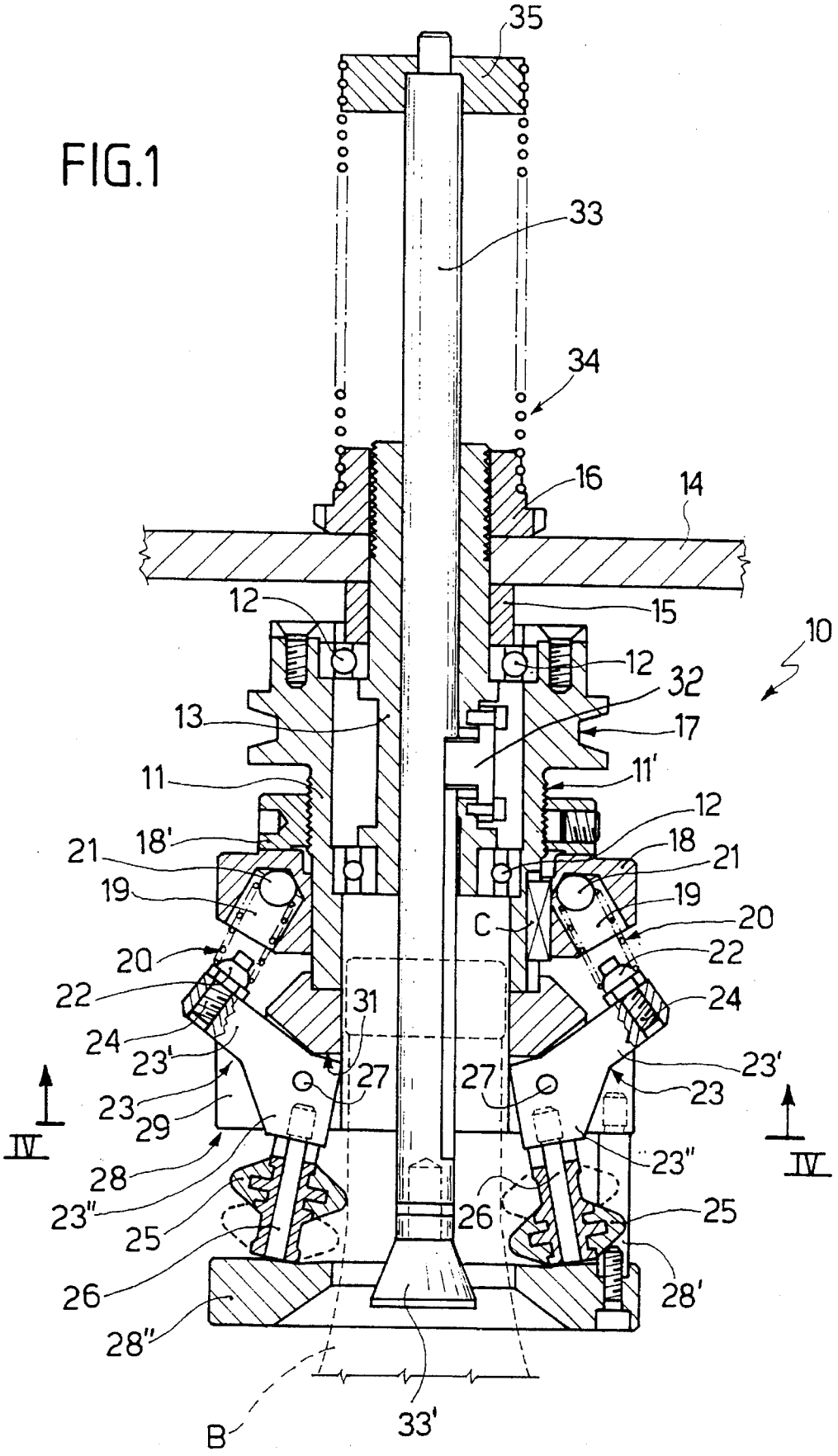
FIG. 1 is a general longitudinal sectional view of the rolling head according to the present invention.
Figure 2:
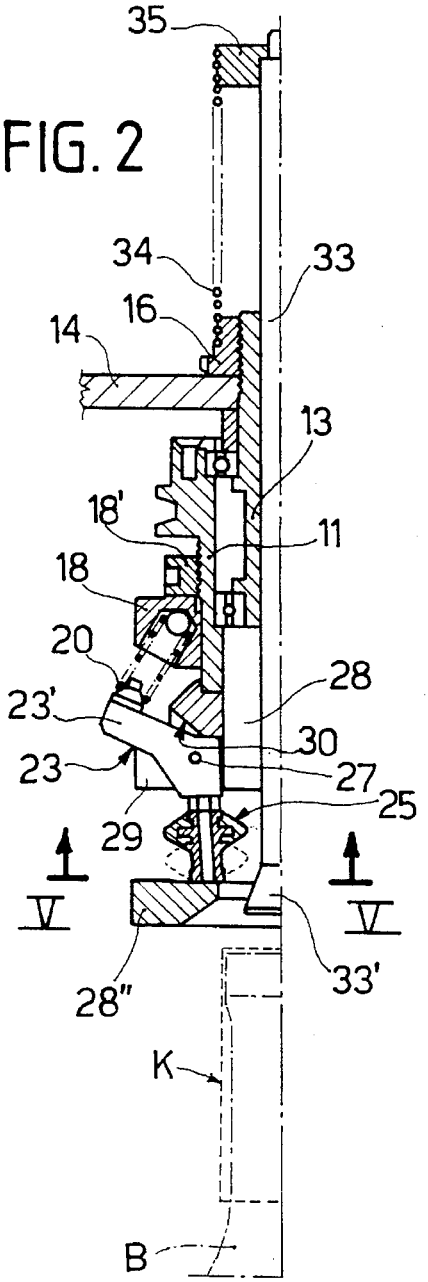
FIG. 2 is a partial sectional view, similar to FIG. 1, of the head in the inactive configuration.
Figure 3:
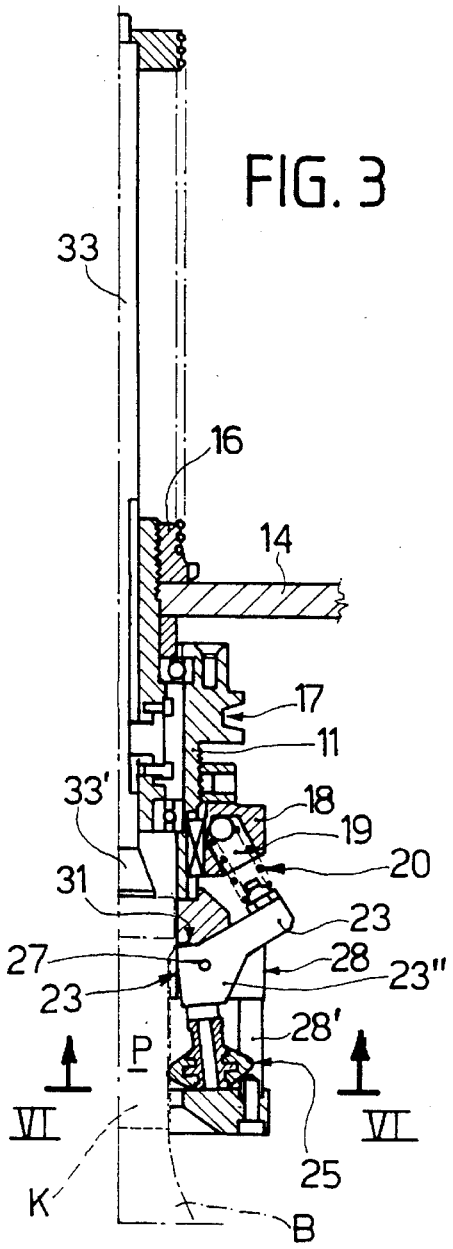
FIG. 3 is a partial sectional view, similar to FIG. 2, of the head in the active position.

With reference to FIGS. 1 to 3, the reference numeral 10 generally designates the rolling head according to the invention, which substantially comprises a hollow rotating body 11 adapted to receive the neck of the bottle B and supported, by means of bearings 12, by a hollow central bush 13 fixed to a rigid support 14 by means of a spacer 15 and a bolt 16 screwing into a threaded end portion of said bush. A pulley 17 for a traction belt (not shown) is formed monolithically on the upper part of the rotating body 11, whereas the lower part of said body is provided with a contrast ring 18 that rotates rigidly with the rotating body but can move axially with respect thereto by virtue of a splined coupling cooperating with a key C. An abutment ring 18' engaging a threaded portion 11' of the rotating body 11 is provided in order to adjust the axial position of the contrast ring 18. A plurality of blind cylindrical seats 19, for example eight, are formed on said contrast ring, are angularly spaced by a constant amount, and are adapted to accommodate a respective plurality of cylindrical springs 20, preferably of the helical type.

Each spring 20 is loosely contained inside the respective seat 19, abuts with one end against the blind bottom of the seat, with the interposition of an orientating ball 21, and acts, with its other end, on a corresponding rocker 23 with the interposition of a spherical tappet 22 adjustable by means of a grub screw 24 to finely adjust the tension of each individual spring 20. Each spring 20 is arranged in a substantially subvertical position, and its axis forms, with the axis of the rotating body 11, an angle preferably comprised between 15° and 20°.

Each rocker 23 has a profile substantially shaped like a wide L and comprises, at one end, an arm 23' that is subhorizontal (with respect to the head portion shown in FIG. 1) and whereon the respective spring 20 acts and, at the other end, a stem 23" for supporting a corresponding presser roller 25 freely rotatably mounted on a respective substantially vertical pivot 26. Each rocker 23 is articulated, by means of a respective pivot 27, to a cylindrical support 28, wherein seats 29 for the rockers are formed, said seats being provided with abutments 30–31 for said rockers (FIGS. 2 and 3). An inlet ring 28" is fixed to the support 28 by means of spacers 28' and is provided with a conical flared portion for easy insertion of the bottle B. Each presser roller 25 (FIGS. 7 and 8) is formed by a cylindrical collar 25' and by a widened circular body 25" adapted to engage, by tangent contact, the cap K at the roller equatorial diameter. The rollers 25 of adjacent pairs are mounted alternately inverted by 180°, as shown in the detail view of FIGS. 7 and 8. The rollers 25 apply to the cap K an elastic pressure P that depends on the tension of the springs 20. Said tension can be changed simultaneously by moving the contrast ring 18 axially and by fixing it in the selected position by means of the abutment ring 18'.

A presser stem 33 is slidingly guided in the central bush 13 of the head by means of a key 32 and ends with an enlarged head 33' for elastically engaging the upper part of the cap K in order to keep it in the correct position during the rolling process. For this purpose, the presser stem 33 is biased by an elastic means 34 subjected to traction and constituted by a cylindrical helical spring, the stiffness whereof can be changed for example according to the vertical extension of the neck of the bottle B being processed.

According to the invention, the upper end of the spring 34 cooperates with an adjustment disk 35 rotatably mounted on the corresponding upper end of the presser stem 33. A groove of a helical thread is formed on the adjustment disk 35 and has the same pitch as the turns of the spring 34, so that said turns mate with said thread. The lower end of the spring is likewise screwed on a corresponding thread provided on a cylindrical extension of the locking bolt 16.

By turning the disk 35 clockwise or counterclockwise, said disk screws on, or respectively unscrews from, the spring 34, reducing or respectively increasing the number of turns of the spring 34 that are elastically active and thus varying the stiffness of said spring.

Figure 7:
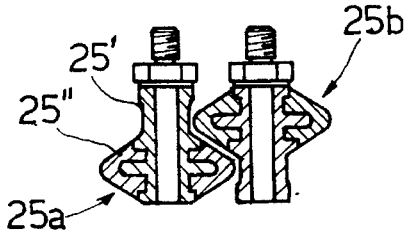
FIGS. 7 and 8 are schematic sectional views, taken along the planes VII—VII and VIII—VIII of FIGS. 5 and 6 respectively.
Figure 8:
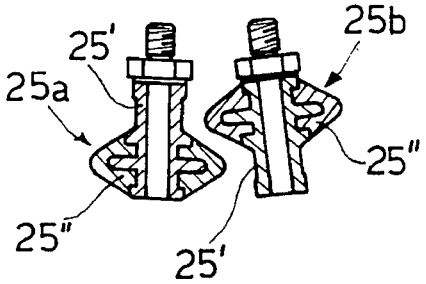
Figure 4:
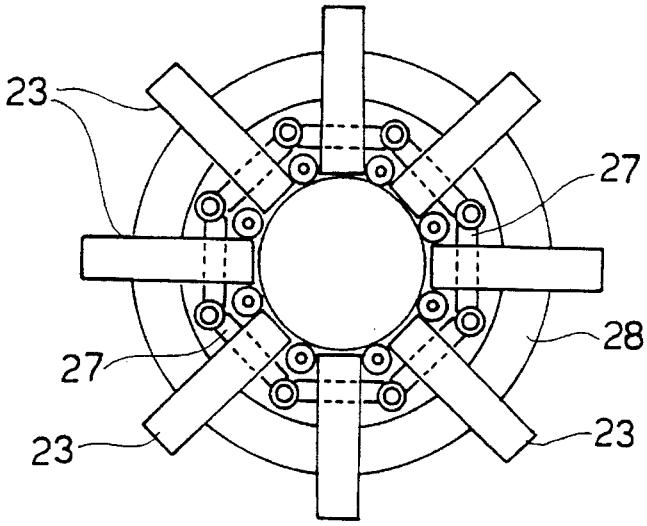
FIG. 4 is a transverse schematic sectional view, taken along the plane IV—IV of FIG. 1.
Figure 5:
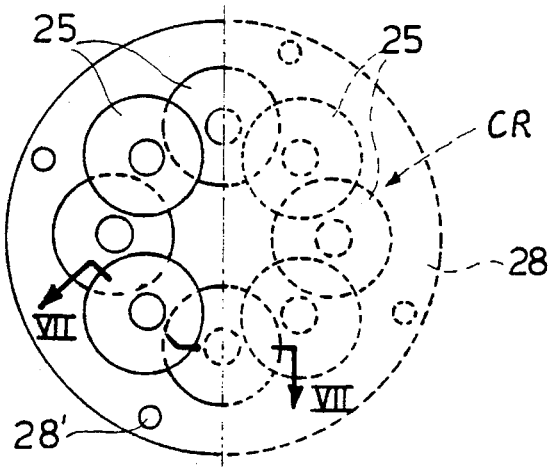
FIGS. 5 and 6 are partial transverse sectional views of the arrangement of the presser rollers in the inactive and active configurations, taken respectively along the plane V—V of FIG. 2 and the plane VI—VI of FIG. 3.

In the inactive condition, the head 10 assumes the configuration shown in FIGS. 2 and 5, wherein the presser rollers 25 form a closed ring CR that partially occupies the circular opening for the passage of the neck of the bottle provided on the inlet ring 28". In this configuration, limited by the contact of the rockers 23 against the corresponding abutments 31, the pairs of adjacent rollers **25*a*–25*b*** partially mutually penetrate (FIG. 7).

Figure 6:
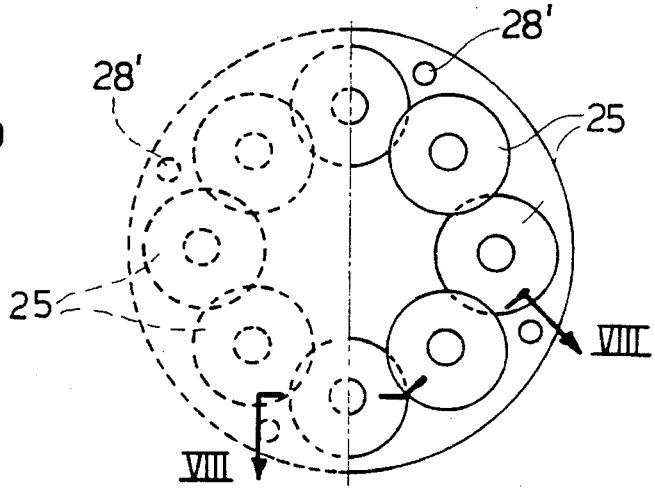

In the operating conditions, the head assumes the configuration shown in FIGS. 3 and 6, wherein the neck of the bottle B, passing in the inlet ring 28" and entering the cavity of the rotating body 11, widens the ring of the presser rollers 25, causing the oscillation of the rockers 23 in contrast with the action of the respective springs 20. Accordingly, the rollers 25 apply to the cap K fitted on the neck of the bottle B a rolling pressure P that makes said cap adhere perfectly to the neck of the bottle even at collars or raised portions or undercuts provided thereon.

The details of execution and the embodiments may of course be altered extensively with respect to what has been described and illustrated by way of non-limitative example without altering the concept of the invention and without thereby abandoning the scope of the invention, defined by the appended claims, wherein the reference numerals are given merely for the sake of better comprehension.

What is claimed is:

1. A rolling head for applying sealing caps on bottles in general, the rolling head comprising:

a rotating body being rotatable about a longitudinal axis thereof;

a contrast ring being slideably axially mounted on said rotating body;

a cylindrical support being rigidly coupled to said rotating body;

a plurality of rockers being pivoted to said cylindrical support;

a plurality of presser rollers for elastically acting on a sealing cap, each presser roller being supported at an end of a respective rocker;

a plurality of springs acting with an adjustable tension between said rockers and said contrast ring; and an abutment ring for fixing in position said contrast ring and adjusting the tension of said springs.

2. Rolling head according to claim 1, wherein each rocker has a profile substantially shaped like a wide L and is provided, at a first end thereof, with a supporting stem for a corresponding presser roller, said roller being freely rotatably mounted on a respective pivot and, at a second end thereof, with a substantially subhorizontal arm, a respective one of said springs acting by interposition of an adjustable spherical tappet on said arm.

3. Rolling head according to claim 1, wherein the springs acting on the respective rockers are of a cylindrical helical type and are arranged so that axis thereof are substantially subvertical, an axis of each spring forming with the axis of the rotating body of the head an angle comprised between 15° and 20°.

4. Rolling head according to claim 1, wherein said cylindrical support comprises seats for receiving an individual one of said rockers and wherein said seats are provided with abutments for said rockers.

5. Rolling head according to claim 1, wherein each presser roller is formed by a cylindrical collar and by a widened circular body, said body engaging by contact the cap at a roller equatorial diameter.

6. Rolling head according to claim 5, wherein rollers forming adjacent pairs are mounted alternately inverted by 180°, so that in an inactive configuration of the head said rollers mutually penetrate to form a closed ring occupying partially an opening for passage of a bottle neck.

7. Rolling head according to claim 1, wherein the rotating body of the head is supported, through bearings, by a hollow central bush, and a presser stem is slideably and axially guided inside a cavity of the bush, said presser stem being urged by an elastic means, said elastic means being constituted by a cylindrical helical spring subjected to traction.

8. Rolling head according to claim 7, wherein a first end of said cylindrical helical spring is engaged by a cylindrical extension of a bolt for fixing said hollow central bush and a second end of said spring is engaged, by threaded coupling, by an adjustment disk being rotatably mounted at an upper end of said presser stem.

9. Rolling head according to claim 8, wherein said adjustment disk is provided with a groove of a helical thread, said groove having a same pitch as turns of said cylindrical helical spring, said turns of the spring engaging said helical groove so that a clockwise or counterclockwise rotation of the disk causes screwing, and respectively unscrewing, of the disk on and from the spring, decrease and respectively increase of a number of elastically active spring turns, and consequent change of a stiffness of said spring.

10. Rolling head according to claim 1, wherein said contrast ring is provided with a plurality of blind cylindrical seats for said plurality of springs acting on the rockers, and wherein each spring abuts against a blind bottom of a respective seat with interposition of an orientating ball.

11. Rolling head according to claim 1, wherein said rotating body of the head is monolithically provided with a pulley for traction belt.

* * * * *